United States Patent [19]

Lerman

[11] 4,119,040

[45] Oct. 10, 1978

[54] VARIABLE TIME FUZE

[75] Inventor: Russell E. Lerman, Dover, N.J.

[73] Assignee: The United States of America as represented by the Secretary of the Army, Washington, D.C.

[21] Appl. No.: 818,487

[22] Filed: Jul. 25, 1977

[51] Int. Cl.[2] ..... F42C 9/10

[52] U.S. Cl. ..... 102/249; 102/279

[58] Field of Search ..... 102/85.2, 85.6, 85, 102/82, 72, 31 R, 27 R

[56] References Cited

U.S. PATENT DOCUMENTS

| | | | |
|---|---|---|---|
| 1,310,892 | 7/1919 | Schneider | 102/85.2 |
| 1,533,756 | 4/1925 | Panigatti | 102/85.2 |
| 3,453,959 | 7/1969 | Hobart et al. | 102/72 X |
| 3,762,267 | 10/1973 | Travor et al. | 102/85.2 X |

FOREIGN PATENT DOCUMENTS

| | | | |
|---|---|---|---|
| 525,171 | 4/1955 | Italy | 102/85.2 |

*Primary Examiner*—David H. Brown

*Attorney, Agent, or Firm*—Nathan Edelberg; A. Victor Erkkila; Costa Perchem

[57] ABSTRACT

A pyrotechnic delay fuze, for use in extended time explosive ordnances, comprising a pyrotechnic delay cord in a spiral race in the base of the fuze. This system is activated through associated ignition materials. Upon initiation and propagation of the delay composition in the spiral race, the fuze provides a longer delay period and greater precision and reliability.

3 Claims, 2 Drawing Figures

VARIABLE TIME FUZE

GOVERNMENT INTEREST

The invention described herein may be manufactured, used and licensed by or for the Government for governmental purposes without the payment to me of any royalty thereon.

BACKGROUND OF THE INVENTION

This invention relates to military time fuzes, and more particularly, to an improved, pyrotechnic delay system therefor.

Pyrotechnic delay fuzes presently in use consist of one or more pressed pyrotechnic delay rings to provide predetermined time intervals between various functioning phases of munition systems. Prior to the present invention, the functioning time for such pyrotechnic delay fuzes was provided by the burning of a fixed amount of black powder or other applicable delay composition which was pressed into a narrow channel within the delay ring. Both the total length of the channel and the intrinsic burning rate of the utilized delay composition predetermines the maximum time capabilities of the system.

The delay composition which is usually black powder is characterized by several deficiencies. First, its marked hygroscopicity with accompanying complex reactions with moisture necessitates special loading procedures to equilibrate powder conditioning. Secondly, its intrinsic burning rate limits the maximum time capabilities of pyrotechnic delay fuzes.

To provide systems with greater latitudes in delay time capabilities and reduced hygroscopicity problems with consequent improved reliability of performance, a need has existed over the past years to find a suitable chemical replacement for the black powder delay composition in fuze delay rings. Past attempts to solve this need involved the use of either a slow-burning black powder composition, designated "coal powder" or gasless pyrotechnic delay composition.

The slow-burning black powder composition has been found unsuitable due to its limited increase in maximum delay time capabilities and its decrease in system reliability as the result of nonuniformity of the supplied material.

The gasless pyrotechnic delay composition had been found unsuitable due to poor propagative characteristics in fuze delay rings. The propagative burning of a pressed column of this type of composition is a combustion reaction in which the fuel and oxidant react to give essentially solid products. Any gaseous products present are chiefly the result of traces of organic materials in the formulation, or impurities in the constituents. As the prime reaction products of the burning gasless pyrotechnic delay composition are continually forming a hard, semi-permeable expanding slag, the aforementioned gases become pressurized. This pressurization increases until relief can be obtained via exit from the delay system. The pressure relief occurs in the form of sporadic partial venting between the delay rings or between a delay ring and the contiguous fuze components. The sporadic venting, which could be very brisant, indicates that the pressure build-up along the delay's reaction interface is not uniform. Both the expanding slag and the erratic pressure are manifested by the poor propagative characteristics of the gasless pyrotechnic delay compositions in the fuze delay rings.

First, the uncontrolled, expanding slag caused the separation and misalignment of the delay rings with consequent occurences of nonpropagation of the delay train. Secondly, as the burning of a material at its reaction interface is directly related to pressure, nonuniformity in the latter produced erratic propagation in the former.

The present invention entails the successful development of delay cord to be used as a replacement for conventional delay rings containing black powder and gasless pyrotechnic delay composition in time fuzes. This invention utilizes the pyrotechnic delay composition in the form of a cord placed in a spiral race of the fuze. The use of the pyrotechnic delay composition disposed in a spiral race, rather than in conventional delay rings, permits longer delay periods, greater burning time reliability by reduced susceptibility to changes in ambient pressure, etc., and accurate adjustment and control of delay periods.

DETAILED DESCRIPTION OF THE PREFERRED EMBODIMENT

Figure 2:
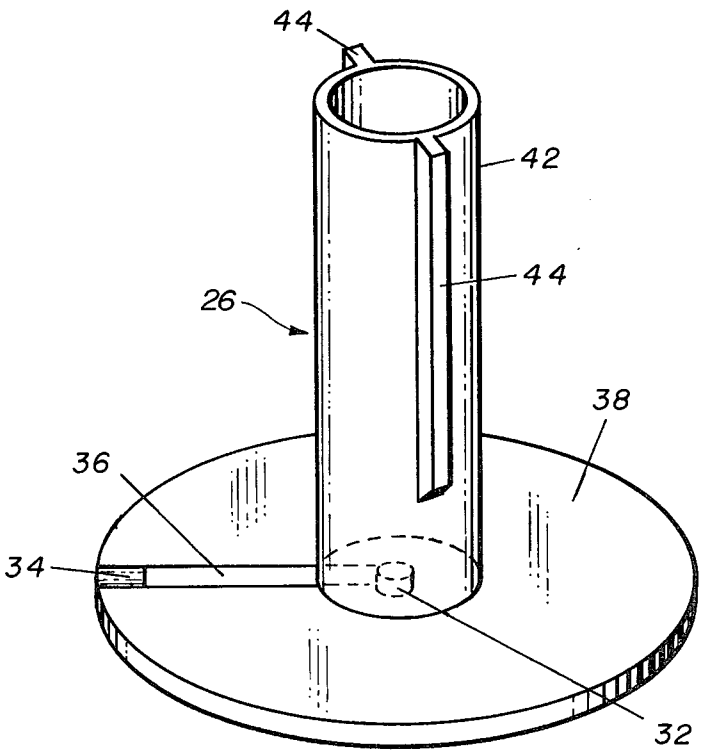
FIG. 2 is an isometric view of the ignition bolt shown in FIG. 1.
Figure 1:
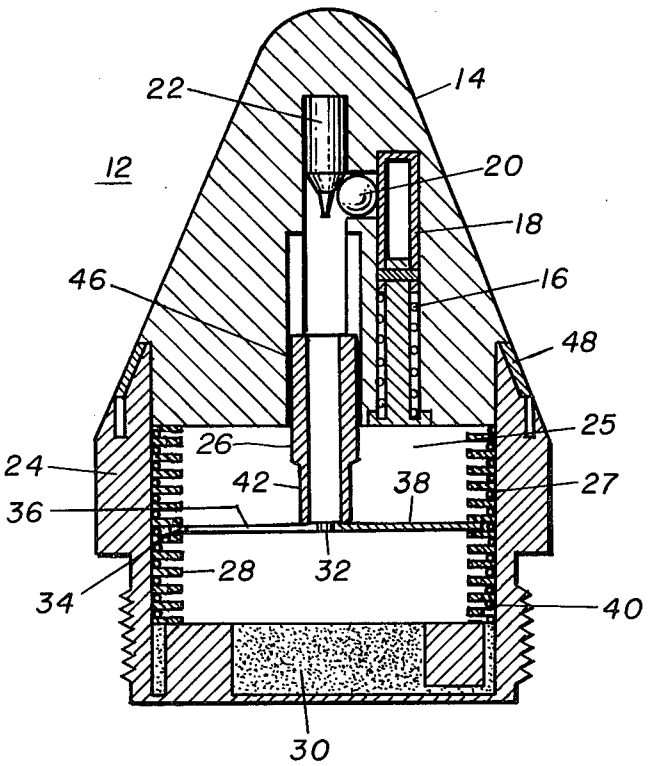
FIG. 1 is a sectional side view of a delay fuze of the present invention showing a spiral race containing the delay composition and an adjustable ignition bolt for igniting and determining the operative length of the delay cord.

Referring to FIG. 1 the head assembly 12 comprises the settable ogive assembly 14, which includes the initiating components consisting of a bias spring 16, detent pin 18, detent ball 20, and firing pin 22. Contiguous to the head assembly 12, is a base assembly 24 consisting of a hollow cylindrical base 25, ignition bolt 26, rigid spiral race or channel 28 and booster charge 30.

The pyrotechnic delay cord 40 is placed in the base of the spiral rigid race 28 located on the interior wall 27 of the hollow cylindrical base 25 and terminates in contact with the booster charge 30. The open edge of the rigid race 28 receives the perimeter of the circular head 38 of the bolt 26 and forms a spiral channel for the head portion 38. The head 38 contains an ignition charge 34 that fires into the delay cord 40, which is positioned along the length of the spiral race 28.

The ignition bolt 26 contains the circular head or disc 38 attached perpendicular to a hollow centerpost 42 through which a firing pin 22 travels and impacts a primer 32. The primer 32 is situated in the center of the circular head 38 and communicates through channel 36 with the ignition charge 34 at the perimeter of head 38 for igniting the delay cord 40. The centerpost 42 has two external flanges 44 that mate with internal slots 46 in the time selection ogive 14. When the ogive 14 rotates, it also rotates the ignition bolt 26 which moves up or down as the circular head 38 turns in the spiral race 28. In this manner the ignition charge 34 can be rotated to the required point along the delay cord 40 in the race 28 so as to limit the effective or operative length of the cord to provide the desired time delay.

In operation, the user can set the time selection by rotating the ogive 14 in relationship to the time ring 48 attached to the hollow cylindrical base assembly 24. The ogive 14 will have readings etched on it for interpolation between the major timing markings on the time ring 48 and a safe setting position in which the primer cannot be initiated. To establish the proper time delay, the movable head assembly 12 orients the ignition charge 34 in the circular head 38 of the ignition bolt 26 with respect to the delay cord 40 contained in race 28.

Upon removal of the safety element (not shown) the bias spring 16 upon setback clears the way for the detent ball 20 to disengage the pin 22, firing the sealed primer 32 which initiates the ignition charge 34. The ignition charge 34 ignites the delay cord 40, which in turn detonates the booster charge 30.

I wish it to be understood that I do not desire to be limited to the exact details of construction shown as described, for obvious modifications will occur to a person skilled in the art.

I claim:

1. A fuze containing a pyrotechnic delay system for use in an explosive ordnance item comprising:

a hollow cylindrical base containing;

a spiral race positioned on the inner wall of said cylindrical base;

a delay cord positioned in said race and communicating with a booster charge;

an ogive rotatably mounted on said base;

an ignition bolt comprising;

a centerpost slidably mounted in and rotated by said ogive;

a circular head integrally mounted normal to said centerpost and peripherally extending into said race;

a primer positioned in said circular head, and a channel communicating between the primer and an ignition charge at the periphery of the circular head for igniting said delay cord;

whereby a predetermined delay action is obtained by rotation of the ogive until the ignition charge in said circular head is positioned at a predetermined point along the delay cord in said race.

2. A fuze as claimed in claim 1, wherein said centerpost contains an axial channel, and a firing pin is positioned in said ogive and is adapted to travel through said axial channel to strike said primer.

3. A fuze as claimed in claim 1, wherein said centerpost is provided with a longitudinal flange sliding engaging a slot in said ogive.

* * * * *